US007204105B2

(12) United States Patent
Hooper et al.

(10) Patent No.: US 7,204,105 B2
(45) Date of Patent: Apr. 17, 2007

(54) TAMPER-PROOF LATCH COVER

(75) Inventors: James Edward Hooper, Santa Rosa, CA (US); G. James Keller, Petaluma, CA (US)

(73) Assignee: Tellabs Petaluma, Inc., Petaluma, CA (US)

( * ) Notice: Subject to any disclaimer, the term of this patent is extended or adjusted under 35 U.S.C. 154(b) by 126 days.

(21) Appl. No.: 10/955,019

(22) Filed: Sep. 30, 2004

(65) Prior Publication Data

US 2006/0065026 A1 Mar. 30, 2006

(51) Int. Cl.
*E05B 13/00* (2006.01)

(52) U.S. Cl. ..... 70/2; 70/203; 70/212; 70/DIG. 30; 200/43.14; 200/43.19; 292/205; 292/281

(58) Field of Classification Search ..... 70/203, 70/212, DIG. 30, 2–13, 164, 177, 178, 180, 70/159, 54–56, DIG. 43, DIG. 56, DIG. 58; 200/43.14, 43.15, 43.11, 43.13, 43.18, 43.19; 292/281–286, 205, 207, 208
See application file for complete search history.

(56) References Cited

U.S. PATENT DOCUMENTS 475,966 A * 5/1892 Morton ..... 292/283
1,938,258 A * 12/1933 Luneburg ..... 292/210
2,169,860 A * 8/1939 Von Hoorn ..... 70/203
2,177,249 A * 10/1939 Hammerly ..... 200/50.01
3,291,924 A * 12/1966 Tharp ..... 200/43.15
3,312,794 A * 4/1967 Hollyday ..... 200/43.15
3,595,040 A * 7/1971 Curl ..... 200/43.15
4,160,137 A * 7/1979 Clement et al. ..... 200/43.15
4,260,861 A * 4/1981 DiMarco ..... 200/43.15
4,793,163 A * 12/1988 MacFarlane et al. ..... 70/2
4,882,456 A * 11/1989 Hovanic et al. ..... 200/43.15
4,978,816 A * 12/1990 Castonguay et al. ..... 200/43.14
5,257,839 A * 11/1993 Nielsen et al. ..... 292/1.13
5,260,528 A * 11/1993 Benda ..... 200/43.14
6,015,956 A * 1/2000 Green ..... 200/43.14
6,058,748 A * 5/2000 Beals et al. ..... 70/203

OTHER PUBLICATIONS

"Southco Compression Latches", [online], [retrieved on Sep. 9, 2004]. Retrieved from the Internet:<URL:http://www.southco.com/pdf/1-1-1-2.pdf>. pp. 32-33, 36-37.

* cited by examiner

*Primary Examiner*—Lloyd A. Gall
(74) *Attorney, Agent, or Firm*—Mark C. Pickering

(57) ABSTRACT

A latch in a door is protected from an unauthorized entry by forming a first bracket that fits around the latch, and a second bracket that is rotatably connected to the first latch. The second bracket covers the latch when rotated to be in a first position, and exposes the latch when rotated to be in a second position.

17 Claims, 3 Drawing Sheets

TAMPER-PROOF LATCH COVER

BACKGROUND OF THE INVENTION

1. Field of the Invention

The present invention relates to latches and, more particularly, to a tamper-proof latch cover.

2. Description of the Related Art

A latch is a fastener that is used to maintain a door in a closed position. A latch typically includes a housing, a core which can be rotated within the housing, and a bar connected to the core that fits into a slot or notch when the core is in a first position, and is removed from the slot or notch when the core is in a second position.

A latch commonly requires a key which must be inserted into a key opening in the latch to rotate the core between the first and second positions. Although a key, such as a hex key or a standard key, provides a degree of security when the core is in the first position and the key has been removed, other devices, such as screwdrivers, can be forced into the key opening and used to rotate the core, thereby allowing unauthorized entry.

A padlock bracket is a device that fits around a latch which allows the shank of a padlock to be inserted through a pair of openings in the bracket such that the shank of the padlock limits access to the key opening in the latch. FIG. 1 shows a perspective view that illustrates a prior-art padlock bracket 100.

As shown in FIG. 1, padlock bracket 100 has a flat base member 110, and sides 112 and 114 that extend away from base member 110. Base member 110, in turn, includes a center opening 116 that is formed through base member 110. In addition, the sides 112 and 114 include padlock openings 120 and 122, respectively, which are formed through the sides 112 and 114.

In operation, a latch is inserted into center opening 116 of padlock bracket 100, and then securely attached to a door. When attached to the door, center opening 116 exposes the key opening of the latch. Following this, the core of the latch is placed in the first (closed) position. Next, the shank of a padlock is inserted through the padlock openings 120 and 122, and the padlock is locked. The shank then limits access to the key opening of the latch.

One drawback of padlock bracket 100 is that, although the shank of a padlock provides increased security by restricting access to the key opening of the core, the shank remains spaced apart from the key opening. As a result, it is still possible to force unauthorized devices past the shank and into the key opening to gain unauthorized access.

This is particularly the case when the diameter of the shank is substantially less than the diameter of the padlock openings 120 and 122. Thus, there is a need for a way of preventing an unauthorized device from being forced into the key opening of a latch.

SUMMARY OF THE INVENTION

The present invention provides a latch cover that prevents an unauthorized device from being forced into the key opening of the latch. The latch cover includes a first bracket that has a first base member. The first base member has a first edge, a second edge that is spaced apart from the first edge, and a center opening that is formed through the first base member. The center opening lies between the first and second edges.

The first bracket also has a first side that extends away from the first edge of the first base member, and a second side that extends away from the second edge of the first base member. The first side includes a first side opening that is formed through the first side, while the second side includes a second side opening that is formed through the second side. The first and second side openings are aligned with each other such that a straight line can pass through the first and second side openings.

The present invention also includes a method of installing a latch and a latch cover on a door. The method includes the step of inserting the latch mechanism into the center opening of the first bracket. The present invention further includes a method of opening a door. The door has a latch attached to the door, and a latch cover attached to the door around the latch. The method includes the steps of inserting a key through the center opening of the latch cover into the latch, and turning the key to open the latch.

A better understanding of the features and advantages of the present invention will be obtained by reference to the following detailed description and accompanying drawings that set forth an illustrative embodiment in which the principles of the invention are utilized.

DETAILED DESCRIPTION OF THE INVENTION

Figure 1:
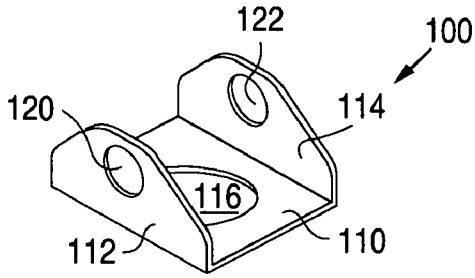
FIG. 1 (Prior Art)
FIG. 1 is a perspective view illustrating a prior-art padlock bracket 100.
Figure 2:
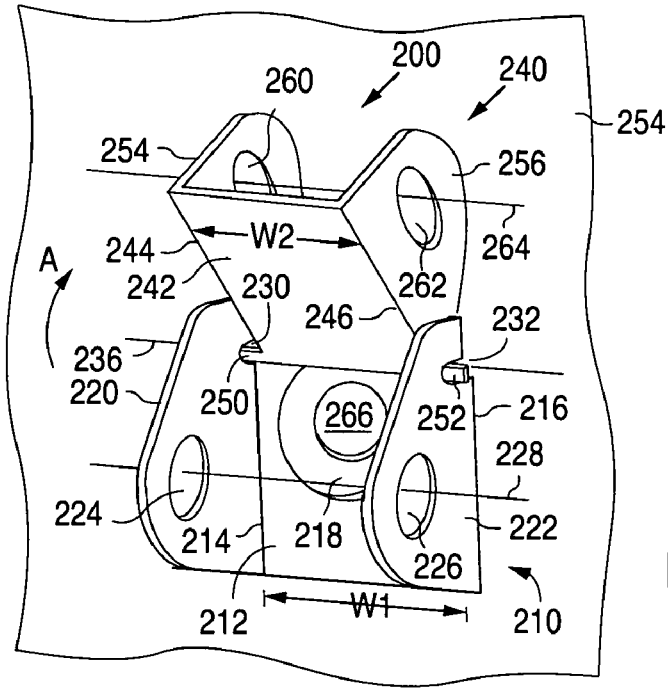
FIG. 2 is a perspective view illustrating an example of a latch cover 200 in accordance with the present invention.

FIG. 2 shows a perspective view that illustrates an example of a latch cover 200 in accordance with the present invention. As described in greater detail below, latch cover 200 includes a swing plate that can be rotated into a position that covers the key opening of the core of a latch.

As shown in FIG. 2, latch cover 200 includes a first bracket 210 that has a base member 212. Base member 212, in turn, includes a first edge 214, a spaced-apart second edge 216, and center opening 218 that is formed through base member 212 between the first and second edges 214 and 216.

In addition, first bracket 210 includes a first side 220 that extends away from first edge 214, and a second side 222 that extends away from second edge 216. First side 220 has a padlock opening 224 that is formed through first side 220, while second side 222 has a padlock opening 226 that is formed through second side 222. The padlock openings 224 and 226 are aligned with each other such that a straight line 228 can pass through the center of both openings 224 and 226.

Further, in accordance with the present invention, the first and second sides 220 and 222 also include first and second retaining openings 230 and 232, respectively, which are formed through the first and second sides 220 and 222. In the FIG. 2 example, the first and second retaining openings 230 and 232 contact base member 212. In addition, the retaining openings 230 and 232 are aligned with each other such that a straight line 236 can pass through the center of both openings 230 and 232.

In further accordance with the present invention, latch cover 200 includes a second bracket 240 that has a base member 242. Base member 242, in turn, includes a third edge 244, a spaced-apart fourth edge 246, a first tab 250 that extends away from the third edge 244, and a second tab 252 that extends away from fourth edge 246.

As shown in FIG. 2, the first and second tabs 250 and 252 lie within, and are held in place by, the first and second retaining openings 230 and 232, respectively. In addition, in the present example, the first and second tabs 250 and 252 are substantially normal to the first and second sides 220 and 222, respectively.

Second bracket 240 also includes a third side 254 that extends away from third edge 244, and a fourth side 256 that extends away from fourth edge 246. Third side 254 has a padlock opening 260 that is formed through third side 254, while fourth side 256 has a padlock opening 262 that is formed through fourth side 256. The padlock openings 260 and 262 are aligned with each other such that a straight line 264 can pass through the center of both openings 260 and 262.

As further shown in FIG. 2, first base member 210 has an inner width W1 between the inner surfaces of the first and second sides 220 and 222. In addition, second base member 240 has an outer width W2 that runs from the outer surface of the third side 254 to the outer surface of the fourth side 256. Second base member 240 fits within first base member 210 such that the second width W2 is less than the first width W1.

In operation, to open door 254, second bracket 240 is rotated upward in the direction shown by arrow A to expose center opening 218. When center opening 218 is exposed, a key can be inserted through opening 218 into the key opening of a latch 266 that is attached to door 254. Once inserted, the key is rotated which turns the core which, in turn, rotates the bar of latch 266 into an open position which allows door 254 to be opened.

To close door 254, if the key has been removed, second bracket 240 is again rotated upward in the direction shown by arrow A to expose center opening 218. When center opening 218 is exposed, the key can be inserted through opening 218 into the key opening of latch 266.

Figure 3:
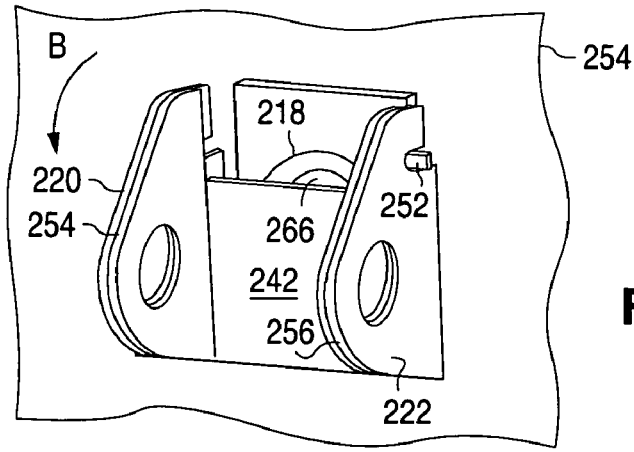
FIG. 3 is a perspective view further illustrating latch cover 200 in accordance with the present invention.

Once inserted, the key is rotated which turns the core which, in turn, rotates the bar of the latch into an closed position which allows door 254 to be maintained in a closed position. Following this, the key is removed. FIG. 3 shows a perspective view that further illustrates latch cover 200 in accordance with the present invention.

As shown in FIG. 3, after the key has been removed, second bracket 240 is rotated downward in the direction shown by arrow B to cover center opening 218. Following this, padlock openings 224/226 and 260/262 are aligned, the shank of a padlock is inserted through openings 224/226 and 260/262, and the padlock is locked.

As further shown in FIG. 3, one of the advantages of the present invention is that base member 242 of second bracket 240 covers the key opening of latch 266. As a result, the present invention provides a tamper-proof latch cover that prevents an unauthorized device from being forced into the key opening of latch 266, thereby securing the closed condition of door 254.

Although FIG. 3 shows base member 242 covering less than all of center opening 218, the sides can be extended upward so that the location of retaining openings 230 and 232 can be moved upward so that the tabs 250 and 252 can be raised, thereby allowing a larger base member 242 to be used which can cover all of center opening 218.

Figure 4A:
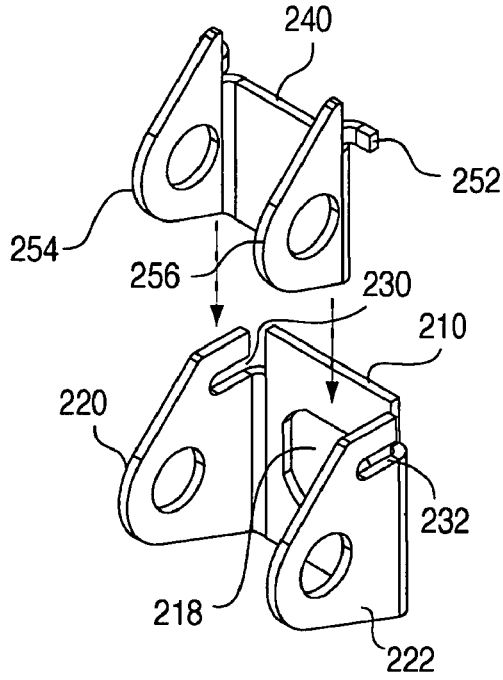
FIGS. 4A–4F are a series of perspective views illustrating an example of the installation of latch cover 200.
Figure 4B:
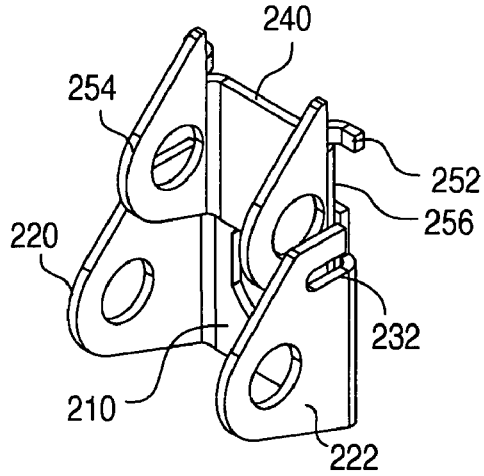
Figure 4C:
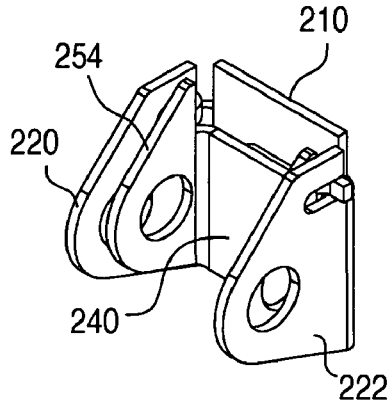

FIGS. 4A–4F show a series of perspective views that illustrate an example of the installation of latch cover 200. As shown in FIGS. 4A–4C, to install latch cover 200, second bracket 240 is positioned over first bracket 210, and then lowered until the tabs 250 and 252 of second bracket 240 are placed into retaining openings 230 and 232, respectively, so that second bracket 240 fits within the sides 220 and 222 of first bracket 210.

Figure 4D:
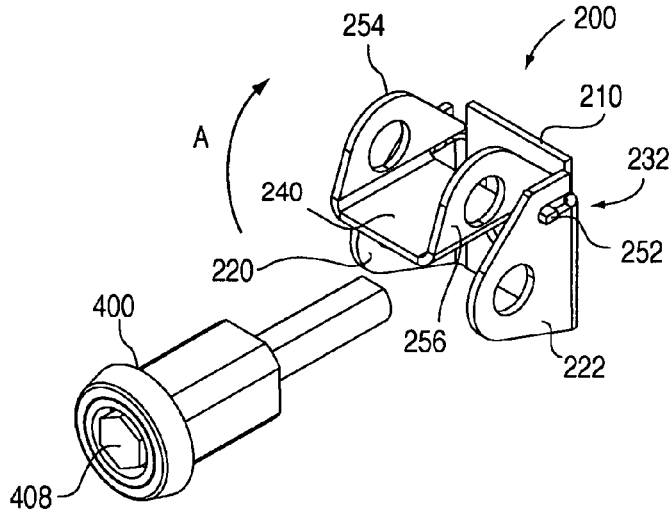
Figure 4E:
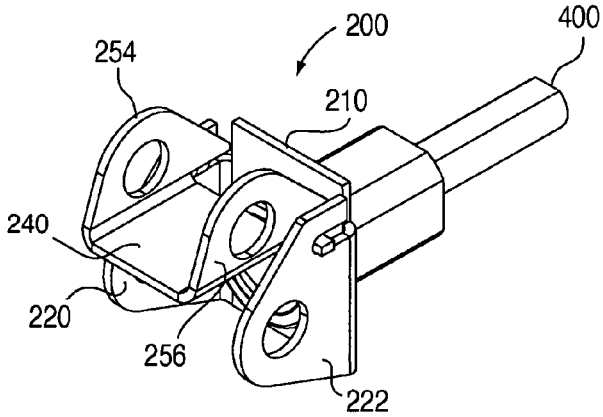

Following this, as shown in FIG. 4D, second bracket 240 is rotated upward in the direction shown by arrow A to expose center opening 218. In addition, a latch mechanism 400 is positioned to be longitudinally aligned with the middle of center opening 218. Next, as shown in FIG. 4E, when center opening 218 is exposed, latch mechanism 400 is inserted through opening 218.

Figure 4F:
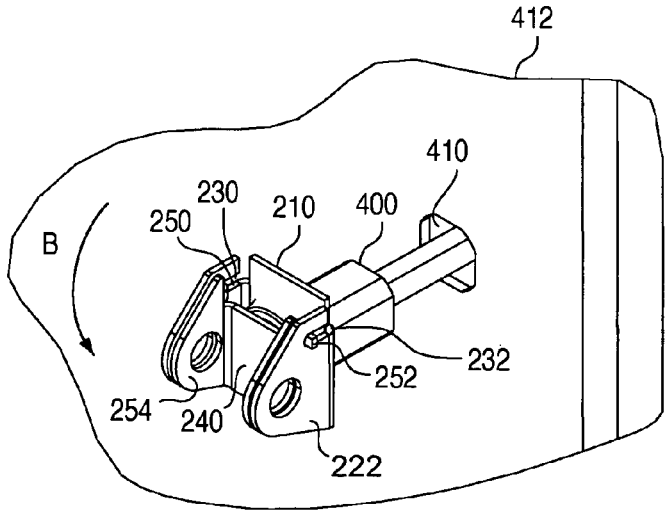

Once inserted, as shown in FIG. 4F, second bracket 240 is rotated downward in the direction shown by arrow B to close center opening 218 and cover a key opening 408 (FIG. 4C) of latch mechanism 400. Following this, latch cover 200 and latch mechanism 400 are inserted into an opening 410 in a door 412, where latch mechanism 400 is securely attached to door 412.

It should be understood that the above descriptions are examples of the present invention, and that various alternatives of the invention described herein may be employed in practicing the invention. Thus, it is intended that the following claims define the scope of the invention and that structures and methods within the scope of these claims and their equivalents be covered thereby.

What is claimed is:

1. A latch cover comprising:

a first bracket having:

a first base member having a first edge, a second edge spaced apart from the first edge, and a base opening formed through the first base member, the base opening lying between, and being spaced apart from, the first and second edges;

a first side extending away from the first edge of the first base member, the first side including a first side opening formed through the first side, and a first retaining opening formed through the first side; and a second side extending away from the second edge of the first base member, the second side including a second side opening formed through the second side, and a second retaining opening formed through the second side, the first and second side openings being aligned with each other such that a straight line normal to the first and second sides can pass through the first and second side openings, the first and second retaining openings being aligned with each other such that a straight line can pass through the first and second retaining openings;

a second bracket having:

a second base member having a third edge, a fourth edge spaced apart from the third edge, a first tab extending away from the third edge and lying within the first retaining opening, and a second tab extending away from the fourth edge and lying within the second retaining opening;

a third side extending away from the third edge of the second base member, the third side including a third side opening that is formed through the third side; and a fourth side extending away from the fourth edge of the second base member, the fourth side including a fourth side opening that is formed through the fourth side, the third and fourth side openings being aligned with each other such that a straight line can pass through the third and fourth side openings.

2. The latch cover of claim 1 wherein the first and second retaining openings extend away from the first base member.

3. The latch cover of claim 1 wherein the first tab is substantially normal to the first side.

4. The latch cover of claim 1 wherein the first base member has a first width between the first and second sides, the second base member has a second width between the third and fourth sides, the second width being less than the first width.

5. A latch cover comprising:

a first bracket having:

a first base member having a first edge, a second edge spaced apart from the first edge, and a base opening formed through the first base member, the base opening lying between, and being spaced apart from, the first and second edges;

a first side extending away from the first edge of the first base member. the first side including a first side opening formed through the first side, and a first retaining opening formed through the first side, and a second side extending away from the second edge of the first base member, the second side including a second side opening formed through the second side, and a second retaining opening formed through the second side, the first and second side openings being aligned with each other such that a straight line normal to the first and second sides can pass through the first and second side openings;

a second bracket having:

a second base member having a third edge, a fourth edge spaced apart from the third edge, a first tab extending away from the third edge and lying within the first retaining opening, and a second tab extending away from the fourth edge and lying within the second retaining opening;

a third side extending away from the third edge of the second base member, the third side including a third side opening that is formed through the third side; and a fourth side extending away from the fourth edge of the second base member, the fourth side including a fourth side opening that is formed through the fourth side, the third and fourth side openings being aligned with each other such that a straight line can pass through the third and fourth side openings.

6. A latch cover comprising:

a first bracket having:

a first base member having a base hole formed through the first base member;

a first side extending away from the first base member, the first side having a first hole and a first cut out formed through the first side, the first hole and the first cut out being spaced apart, the first cut out extending away from the first base member along a length of the first cut out; and a second side extending away from the first base member, the second side having a second hole and a second cut out formed through the second side, the second hole and the second cut out being spaced apart, the second cut out extending away from the first base member along a length of the second cut out; and a second bracket having:

a second base member having a first tab that extends away from the second base member and lies within the first cut out, and a second tab that extends away from the second base member and lies within the second cut out;

a third side extending away from the second base member, the third side having a third hole formed through the third side; and a fourth side extending away from the second base member, the fourth side having a fourth hole formed through the fourth side.

7. The latch cover of claim 6 wherein the first and second holes are aligned with each other such that a straight line normal to the first and second sides can pass through the first and second holes.

8. The latch cover of claim 7 wherein the straight line passes through a center of the first and second holes.

9. The latch cover of claim 7 wherein the first hole is surrounded by the first side.

10. The latch cover of claim 7 wherein the first and second cut outs are aligned with each other such that a straight line normal to the first and second sides can pass through the first and second cut outs.

11. The latch cover of claim 6 wherein the first, second, third, and fourth holes are aligned with each other such that a straight line normal to the first, second, third, and fourth sides can pass through the first, second, third, and fourth holes.

12. The latch cover of claim 11 wherein the first tab is substantially normal to the first side.

13. The latch cover of claim 6 wherein the first base member has a first width between the first and second sides, the second base member has a second width between the third and fourth sides, the second width being less than the first width.

14. A latch cover comprising:

a first bracket having:

a first base member having a base hole formed through the first base member;

a first side extending away from the first base member, the first side having a first hole and a first cut out formed through the first side, the first hole and the first cut out being spaced apart; and a second side extending away from the first base member, the second side having a second hole and a second cut out formed through the second side, the second hole and the second cut out being spaced apart; and a second bracket having:

a second base member having a first tab that extends away from the second base member and lies within the first cut out, and a second tab that extends away from the second base member and lies within the second cut out;

a third side extending away from the second base member, the third side having a third hole formed through the third side; and a fourth side extending away from the second base member, the fourth side having a fourth hole formed through the fourth side, the second base member to rotate towards and away from the first base member via the first and second tabs rotating within the first and second cut outs, respectively.

15. The latch cover of claim 14 wherein the first base member has a first width between the first and second sides, the second base member has a second width between the third and fourth sides, the second width being less than the first width.

16. The latch cover of claim 14 wherein the first, second, third, and fourth holes are aligned with each other such that a straight line normal to the first, second, third, and fourth sides can pass through the first, second, third, and fourth holes.

17. The latch cover of claim 16 wherein when the first, second, third, and fourth holes are aligned with each other, the first base member is spaced apart from the second base member.

* * * * *

UNITED STATES PATENT AND TRADEMARK OFFICE

CERTIFICATE OF CORRECTION

PATENT NO. : 7,204,105 B2
APPLICATION NO. : 10/955019
DATED : April 17, 2007
INVENTOR(S) : Hooper et al.

It is certified that error appears in the above-identified patent and that said Letters Patent is hereby corrected as shown below:

Column 5,

Line 14, delete “member.” and replace with --member,--.

Signed and Sealed this

Twenty-ninth Day of May, 2007

JON W. DUDAS
*Director of the United States Patent and Trademark Office*